US005316453A

United States Patent [19]

Schwing

[11] Patent Number: 5,316,453

[45] Date of Patent: May 31, 1994

[54] SLURRY PUMP WITH DISCHARGE CYLINDERS, ESPECIALLY TWO-CYLINDER CONCRETE PUMP

[75] Inventor: Friedrich Schwing, Gelsenkirchen, Fed. Rep. of Germany

[73] Assignee: Friedrich Wilh. Schwing GmbH, Fed. Rep. of Germany

[21] Appl. No.: 33,882

[22] Filed: Mar. 19, 1993

[30] Foreign Application Priority Data

Mar. 19, 1993 [DE] Fed. Rep. of Germany ..... 4208754

[51] Int. Cl.[5] ..... F04B 7/00; F04B 15/02

[52] U.S. Cl. ..... 417/516; 417/900; 417/519

[58] Field of Search ..... 417/900, 512, 517, 519, 417/532

[56] References Cited

U.S. PATENT DOCUMENTS

| | | | |
|---|---|---|---|
| 2,033,338 | 3/1936 | Kirby | 417/900 |
| 3,298,322 | 1/1967 | Sherrod | 417/900 |
| 3,663,129 | 5/1972 | Antosh | 417/516 |
| 3,667,869 | 6/1972 | Schlecht | 417/900 |
| 3,963,385 | 6/1976 | Caban | 417/517 |
| 4,343,598 | 8/1982 | Schwing et al. | 417/517 |
| 4,345,883 | 8/1982 | Westerlund et al. | 417/519 |
| 5,257,912 | 11/1993 | Oakley | 417/900 |

FOREIGN PATENT DOCUMENTS

| | | |
|---|---|---|
| 0016410 | 10/1980 | European Pat. Off. . |
| 0315750 | 5/1989 | European Pat. Off. . |
| 2052583 | 5/1972 | Fed. Rep. of Germany . |
| 2909964 | 9/1980 | Fed. Rep. of Germany . |
| 3243738 | 5/1984 | Fed. Rep. of Germany . |

*Primary Examiner*—Richard A. Bertsch

*Assistant Examiner*—Peter Korytnyk

*Attorney, Agent, or Firm*—Kinney & Lange

[57] ABSTRACT

A slurry pump for mixing concrete includes a charge funnel, a pair of discharge cylinders, and a discharge line operable with each other to form a slurry flow control. A control valve has an exit port connected with the discharge line and an entrance port that is alternatively positioned in front of an opening of each discharge cylinder. A pair of gate valve disks are positioned one on each side of the entrance port. The size of each gate valve disk conforms to a surface between the discharge cylinder openings such that in a change-over midpoint of the control valve the openings of the discharge cylinders are sealed off by the gate valve disks, and the entrance port and the control valve is sealed off on the surface between the discharge cylinders for the execution of a partial stroke a discharge cylinder piston which compresses the drawn in slurry. A compensation cylinder prevents slurry interruptions during the change-over the control valve. A combinatorial circuit controls the drive of each discharge cylinder and the slurry flows such that during the change over of the control valve the compensation cylinder pushes slurry into the discharge line and such that during a subsequent discharge cycle of one of the discharge cylinders the compensation cylinder is filled with slurry. A combinatorial circuit lets the drive of the discharge cylinder actually delivering slurry deliver faster in proportion to the amount of the slurry taken in by the compensation cylinder. The combinatorial circuit delays the change over of the control valve such that one of the gate valve disks closes off the opening of the discharge cylinder associated with it.

16 Claims, 6 Drawing Sheets

SLURRY PUMP WITH DISCHARGE CYLINDERS, ESPECIALLY TWO-CYLINDER CONCRETE PUMP

BACKGROUND OF THE INVENTION

The invention pertains to a slurry pump with discharge cylinders, especially a two-cylinder concrete pump.

The principal method of operation of known slurry pumps, especially those utilized for the pumping of concrete, entails for two-cylinder piston pumps that both discharge pistons in the discharge cylinders, as a rule, are driven by hydraulic cylinders in such a way that while the one piston delivers, the other sucks in. The exchange of the piston play occurs always in the end positions of the stroke. The motion of the pistons are synchronized, i.e., when the hydraulic cylinder driving the discharge cylinder, e.g., is loaded on the piston side with hydraulic fluid (oil) , the oil displaced on the piston side is fed through a cross-over line to the piston rod side of the sucking discharge cylinder, so that the latter, due to identical surface ratios of the two drive cylinders, completes its intake stroke at the same speed as the advancing cylinder. Thereby, both pistons in the discharge cylinders always simultaneous reach their end positions.

Since each discharge cylinders in during the discharge stroke connected with the discharge line or respectively during the intake stroke with a charge funnel containing the slurry, a combinatorial circuit is required which reverses the concrete flow between the strokes after arrival at the end of the stroke, and which reverses the connection of the discharge cylinders with the discharge line or respectively with the charge funnel.

Typical for these and other slurry pumps is that between the discharge strokes, i.e. for the length of time of the change-over of the control organ, the delivery of the discharge cylinders comes to a halt. This causes an interruption of the slurry delivery. With the known slurry pump, the duration of the interruption is here further increased relative to the degree of filling, which depends on the air content, the flow resistance of the concrete, the suction speed as well as the cylinder diameter, i.e. by the length of time needed by the discharge cylinders at the beginning of the discharge stroke to compress the slurry.

To this comes a further unpleasant phenomenon, i.e. the back-flow of the slurry from the discharge line into the pumping cylinder during the switch-over phase of the concrete valve.

The interruptions of the delivery flow as a whole have a detrimental effect. The actual result is a pulsating delivery that causes vibrations. These have a particularly detrimental effect, if the slurry pump is installed on a vehicle and the discharge line is attached to a hinged distribution mast, since this results in an oscillatory system that shows resonance phenomena at the common cylinder stroke frequencies.

From this evolves the request to create a pump with which a continuous delivery stream can be obtained. In accordance with a state of the art (A) efforts have already been made to shorten the interruptions of the slurry delivery between the discharge strokes of the discharge cylinders or even to eliminate them.

In such an already known suggestion (U.S. Pat. No. 3 663 129), there from which the invention starts, is for this purpose a compensation cylinder, which that during the changeover of a swivel which is pipe constructed as a uniform hollow body, pushes slurry into the discharge line which during the subsequent discharge stroke of one of the two discharge cylinders is filled with slurry from the discharge line. This occurs with the outlet of the compensation cylinder, with the hollow body serving for the control of the concrete stream, being controlled in the same way as the openings of the discharge cylinders. The combinatorial circuit works with limit switches which are operated by the discharge cylinder pistons and initiates the intake or respectively the discharge stroke of the compensation cylinder.

A two-cylinder concrete pump of this type does not achieve the objective of a steady pumping of concrete through the discharge line. This is so , because such pumps lack the capability to compress the concrete that is drawn in each time and, therefore, cause at the beginning of each piston stroke a stoppage of the concrete flow.

According to another state of the art (B), i.e. of the DE-OS 29 09 964, it is known to achieve the concrete flow control with a pipe shunt (switch) that is realized by two S-shaped pipes. These pipes are arranged in the charge funnel in such a way that they can be swiveled and are bent like an "S". Each pipe is with its openings in continuous contact with a discharge line connection lying on a side of the charge funnel, while the other opening serves an entrance port and is alternatingly aligned with the opening of the discharge cylinder belonging to it, located on the opposite side of the charge funnel, or released so that the discharge cylinder opening is opened into the charge funnel and the cylinder is able to suck in the slurry.

The necessity to provide several swivel pipes for the control of the slurry flow results from the following. The discharge interruptions are not compensated for through the discharge stroke of a compensation cylinder. By that the combinatorial circuit controls the cylinder such that during the duration of the effective discharge stroke of a discharge cylinder, shortened by the degree of filling, the other discharge cylinder sucks in the slurry at substantially higher speed over a full stroke. In a first change-over step the swivel pipe valve belonging to this cylinder closes with its valve disk the opening of this discharge cylinder. The discharge cylinder subsequently to this also at increased speed executes a partial stroke corresponding to the missing fill volume and thereby compresses the drawn-in slurry. The assigned swivel pipe valve in a second change-over step reaches its end position, i.e. the discharge cylinder reaches with its precompressed slurry content a pump readiness position.

This last-mentioned state of the art is not only less favorable, because of the substantially higher speed for intake and compression stroke due to higher total switch-over time caused by multiple switch paths, but necessitates, due to the two required swivel pipe valves, a substantially higher technical expenditure.

SUMMARY OF THE INVENTION

To achieve a pulsation-free continuous delivery without the disadvantages of the state of the art, the invention is based on a novel way of looking at the situation of the previously known two-cylinder slurry pumps, which in the following is discussed on hand of the example of a known pump II of this design which has neither a precompression nor a compensation cylinder. For such a slurry pump, the time for the effective discharge stroke (pump stroke) is determined by the effectively delivered concrete feed quantity and by the volumetric efficiency factor $\eta$.

Accordingly, valid for $\eta=100\%$, i.e. complete cylinder filling through the suction, is for the pump stroke the principal equation $$t_{Fo} = \frac{V_o}{Q_o} \cdot 3.6 \quad [1]$$

In this are:

$t_{Fo}$=Time for the effective pump stroke in (sec.) at 100% intake filling $v_o$=Total Volume of the discharge (pump) cylinders in [$dm^3$]

$Q_o$=Effective delivered concrete feed quantity in ($m^3$/hrs).

With consideration of a volumetric efficiency factor $\eta$ the equation is $$t_{F1} = \frac{V_o \cdot \eta \cdot 3.6}{Q_o} \quad [2]$$

Applied to the state of the art (B), if a continuous discharge flow has to be achieved according to its definition of goals, the following time equivalency must be given:

$$t_F = t_S + t_K + t_{Sch} \quad [3]$$

In this are:

$t_S$=time for the intake stroke $t_K$=time for the compression stroke $t_{Sch}$=total time for the change-over of the concrete valve and various hydraulic valves.

Belonging to these times are:

$V_o$=the volume moved by the piston of the sucking feed cylinder (equal to the full cylinder volume)

$V_K$=the missing intake fill volume moved by the compressing piston according to the equation $$V_K = V_o(1-\eta) \quad [4].$$

From the cylinder run times for the intake and compression stroke, and the cylinder volumes belonging to them, result concrete feed quantity values $Q_S$* and $Q_K$*. Since these values can be freely selected, let us for the further derivation set the precondition $$Q_S^* = Q_K^* = Q^* \quad [5]$$

Insertion in equation [3] results in $$\frac{V_o \cdot \eta \cdot 3.6}{Q_o} = \frac{V_o \cdot 3.6}{Q^*} + \frac{V_o \cdot (1-\eta) \cdot 3.6}{Q^*} + t_{Sch}$$

Since the running speed of a piston in a cylinder is proportional to the discharge quantity, the factor f1, by which the running speed of the piston for suction and compressing in a pump (I) according to the state of the art (B) must be greater then the running speed of the pistons for the pumping, is determined as the Quotient from Q* and $Q_o$, i.e.

$$f_1 = \frac{Q^*}{Q_o} = \frac{2-\eta}{\eta - \frac{t_{Sch}}{t_{Fo}}} \quad [7]$$

For an example common in practice results at the condition:

$Q_o$=120 ($m^3$/hrs)

$V_o$=83.5 (l)

$\eta$=0.85

$t_{Sch}$=0.9 (sec) (for two concrete valves and hydraulic valves)

$$t_{FO} = \frac{V_o \cdot 3.6}{Q_o} = 2.505 \text{ (sec)}$$

for f1 a value of f1=2.342.

This such determined factor f1 for a continuously delivering pump (I) according to the state of the art (B) is, however, not yet a true comparison value that substantiates the advantages of the invention.

This is so, because for the purpose of comparison a pump (II) that is still widely used in practice, which is free of any measures taken for a continuous delivery, is to be used. This means a pump for which the cylinder speed during the intake and during the pumping are equal, and the delivery stream is interrupted during the switching of the concrete valve.

If one wants to achieve with such a pump (II) an effective $Q_o$ on average, even if discontinuously, one must during the effective discharge stroke achieve a discharge quantity Q** that is larger than $Q_o$.

The total time for a pumping cycle $t_{ges}$ results herein from the time intervals $t_{Fo}$ (Time for a full cylinder stroke) and $t_{Sch}$ (Time for the switching of the concrete valve and various hydraulic valves), i.e.

$$t_{ges} = t_{Fo} + t_{Sch} \quad [8]$$

where the time $t_{Fo}$ for a full discharge stroke consists of the time intervals $t_K$ (time for the compression of the sucked concrete, i.e. adjustment of the missing intake fill volume) and $t_{Fl}$ (time for the effective pump stroke according to equation [2]) is , therefore $$t_{Fo} = t_K + t_{Fl} \quad [9]$$

The factor f2, by which Q** for the aforementioned pump (II) must be larger than $Q_o$, is therefore $$f_2 = \frac{t_{ges}}{t_{F1}} = \frac{1 + \frac{t_{Sch}}{t_{Fo}}}{\eta} \quad [10]$$

Since aforementioned pumps (II), as a rule, do contain only one control valve, the change-over time is shorter than for a pump (I) with several valves.

In the aforementioned practical example, the change-over time is to be used at $t_{sch}$=0.5 (sec), from which for f2 a value amounting to f2=1.4113 results. The comparison of f1 and f2 says that the maximal cylinder running speed (intake/compressing) for a continuously delivering pump (I) according to the state of the art (B) in comparison with a type-conform pump (II) is relatively increased by the factor f3 according to the equation $$f_3 = \frac{f_1}{f_2} \quad [11]$$

Hence, in the described practical example by the factor $$f_3 = \frac{2.342}{1.4113} = 1.659$$

From the aforementioned explanations it can be seen that under otherwise equal conditions concerning delivered discharge quantity ($Q_o$), discharge cylinder volume ($V_o$) and volumetric efficiency factor ($\eta$), the running speed of the piston is essentially/considerably and alone determined by the change-over time $t_{Sch}$.

High cylinder speeds lead to higher wear of the discharge piston and, due to the higher flow resistance of the intake stream of the slurry in the discharge cylinders, to an increased vacuum which reduces the degree of filling of the discharge cylinders and thereby lowers the volumetric efficiency factor further.

According to the invention, it follows that a discharge stroke of the compensating cylinder follows immediately after the discharge stroke of a discharge cylinder, and hence, the up to now occurring discharge pause in this phase is avoided. Furthermore, according to the invention, the discharge stroke of the other discharge cylinder follows immediately after the discharge stroke of the compensating cylinder, so that all together delivery pauses can no longer occur. This assures the invention further by that during the discharge stroke of the compensating cylinder the changeover of the control valves inclusive of the various hydraulic valves, as well as the compression stroke, takes place.

Accordingly there are for the pump (II) two separate time and volume equivalency evaluations to be conducted where, for comparison with the state of the art, the following layout data is to be applied:

| | |
|---|---|
| $Q_o$, $V_o$, $\eta$ | according to pump (I) and (II) |
| $t_{Sch}$ | according to pump (II) (only for one concrete valve) |
| $t_K$ | unrestricted choice. |

The volume ($V_A$) of the compensating cylinder is determined by the first time and volume equivalency consideration, which refers to the pumping phase of the compensating cylinder.

The duration of the pumping phase of the compensating cylinder ($t_A$) is equal to the sum of change-over time ($t_{sch}$) and compression time ($t_K$), i.e.

$$t_A = t_{Sch} + t_K \quad [12]$$

or starting with the requirement that the concrete feed quantity of the compensating cylinder must be equal to $Q_o$ $$t_A = \frac{V_A}{Q_o} \cdot 3.6 \quad [13]$$

The Volume $V_A$ of the compensating cylinder calculates, therefore, to yield $$V_A = \frac{Q_o}{3.6} \cdot (t_{Sch} + t_K). \quad [14]$$

The second time and volume equivalency consideration intends to determine the run time or the running speed of the piston of the discharge cylinder during the pump stroke.

The volume ($V_p$) moved by the piston of a discharge cylinder during the effective pump stroke is $$V_P = V_o \cdot \eta \quad [15]$$

where the effective volume transferred hereby to the discharge line is reduced, i.e. through the removal of the compensation volume $V_A$ during this Phase, i.e.

$$V_{P_{eff}} = V_o \cdot \eta - V_A \quad [16]$$

As described in the first part of the combination of characteristics according to the invention, an acceleration of the effective running speed of the piston in this pumping discharge cylinder occurs for the compensation for the reduction of the effective discharge volume of the pumping discharge cylinder, which results in a pump discharge quantity Q*** that is and must be increased to such an extent that the discharge quantity effectively transferred to the discharge line is equal to $Q_o$.

In a functional equation for the determination of the time $t_{F*}$ for the effective pump stroke, resulting from the discharge quantity Q*, is this expressed as:

$$t_{F***} = \frac{V_o \cdot \eta - V_A}{Q_o} \cdot 3.6 \quad [17]$$

and, compared with equation (2)

$$t_{F1} = \frac{V_o \cdot \eta \cdot 3.6}{Q_o} \quad [2]$$

it follows that, since times and speeds and therewith times and discharge quantities are reversely proportional, a factor f4 equal to $$f_4 = \frac{t_{F1}}{t_{F*}} = \frac{Q*}{Q_o} = \frac{1}{1 - \frac{V_A}{V_o \cdot \eta}} \quad [18]$$

by which the running speed of the piston of the pumping discharge cylinder of the pump (III) on removal of discharge product from the discharge line through the compensating cylinder is higher than without this removal.

Here, too, shows up the dependency of the cylinder speed, indirectly through $V_A$, from the change-over time $t_{Sch}$.

Using the aforementioned practical example for pump (I) and pump (II) as the basis and assuming herein for the compression stroke of the pump (III) a discharge quantity $Q_K = 1{,}5 \cdot Qo$, then $t_K$ is calculated as $$t_K = \frac{V_o \cdot (1 - \eta)}{Q_K} \cdot 3.6 \quad [19]$$

that is $$t_K = 0.25 \text{ (sec)}$$

and following from that, $V_A$ according to equation (14) as $$V_A 32\ 25 \text{ (dm}^3\text{)}$$

from which a value for the factor f4 results, amounting to $$f_4 = 1.543.$$

The relative increase factor f5 in comparison to the pump (II) is, therefore $$f_5 = \frac{f_4}{f_2} \quad [20]$$

and is calculated in the described practical example as $$f_5 = \frac{1.543}{1.4113} = 1.0933$$

The preceding deductions do show that the invention succeeded in achieving both, the desired continuity of the output as well as to increase the cylinder speed, according to factor $f_5 = 1.0933$, only insignificantly, in contrast with the state of the art (pump I), for which the cylinder speed is increased by factor $f_3 = 1.659$, and thereby to avoid the disadvantages of this state of the art.

BRIEF DESCRIPTION OF THE DRAWINGS

The details, further characteristics and other advantages of the invention result from the following description of a form of execution based on the figures in the drawing.

Shown is by

DETAILED DESCRIPTION OF THE PREFERRED EMBODIMENTS

Figure 1:
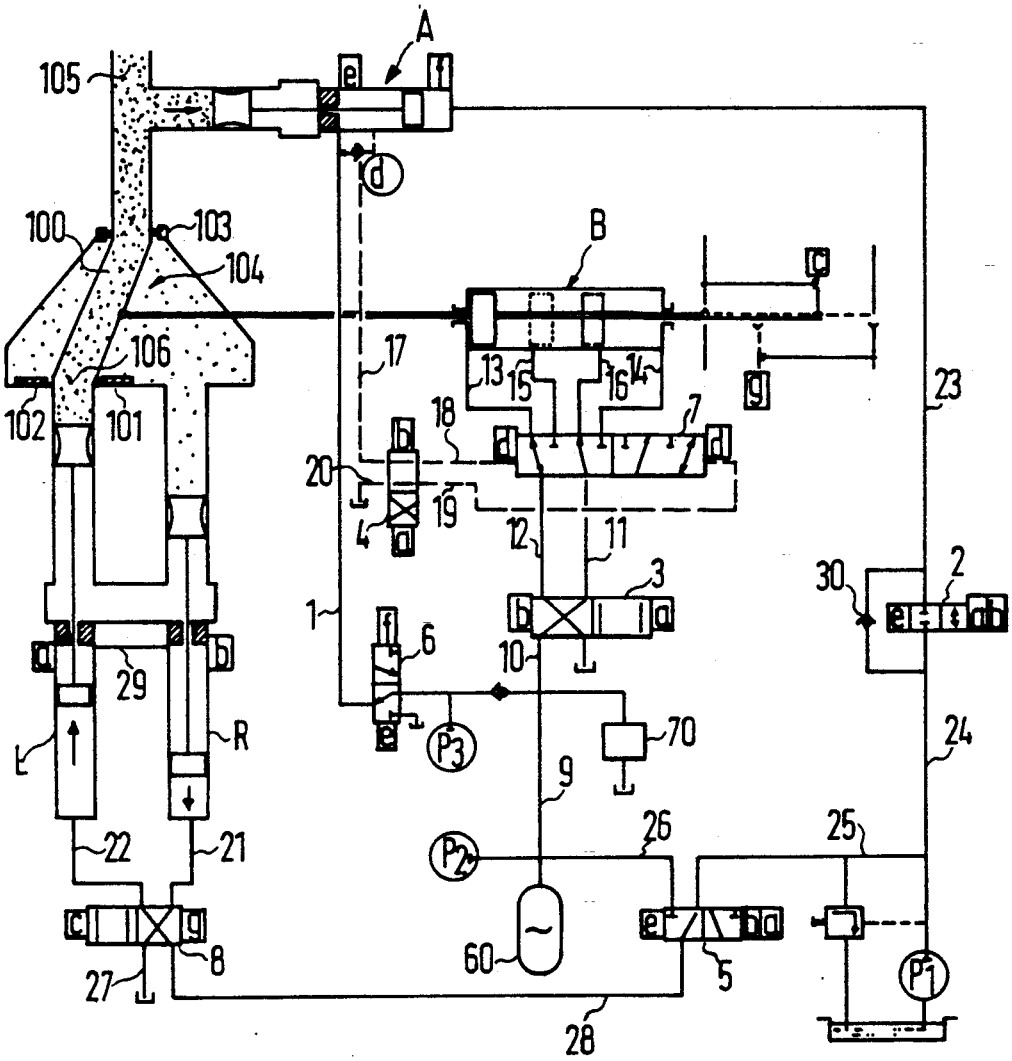
FIG. 1 a combinatorial circuit according to the invention.
Figure 2:
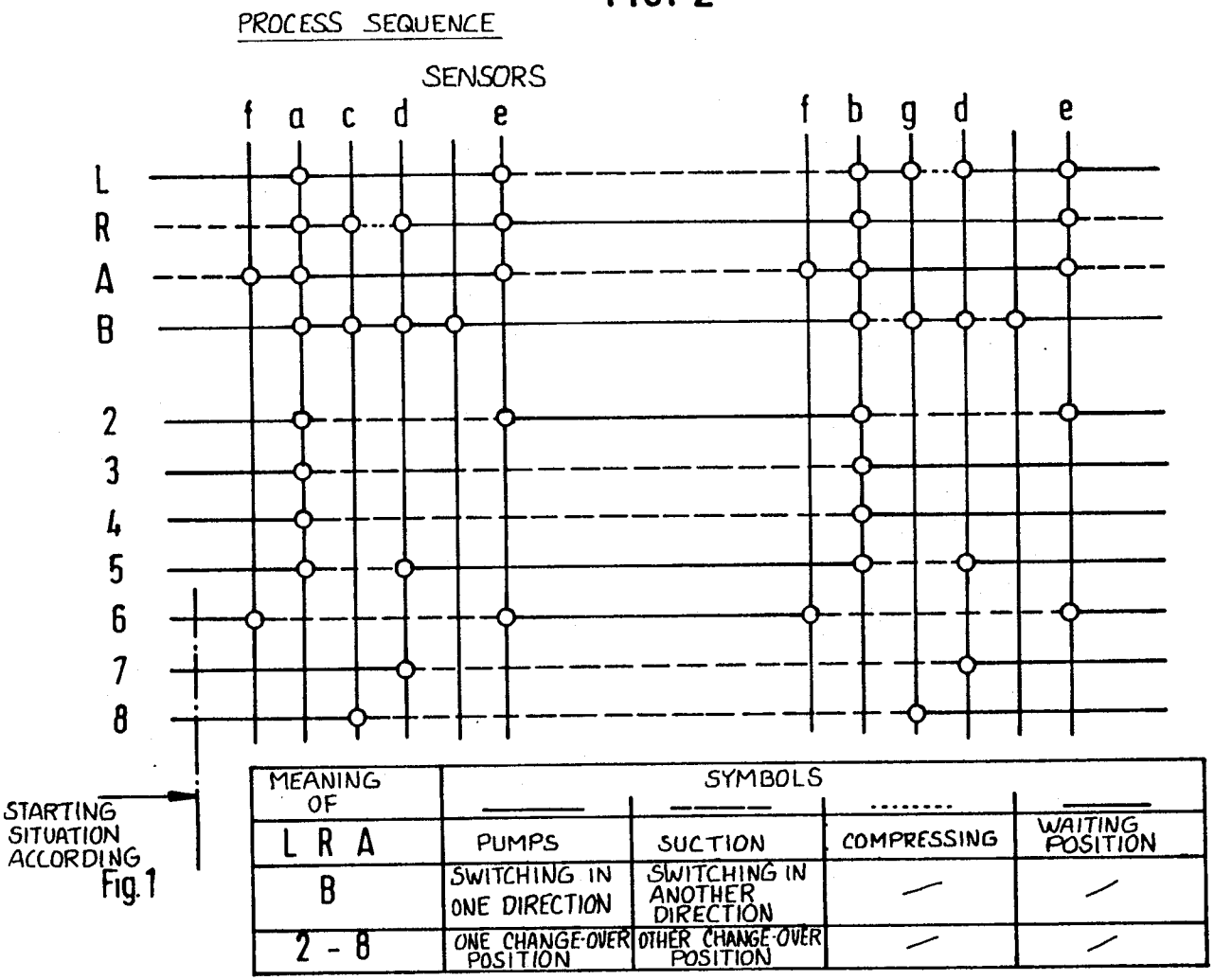
FIG. 2 a detail of the combinatorial circuit.

The depictions of the figures is based on a two-cylinder concrete pump. The two discharge cylinders are labelled L and R. The letter A describes, however, a compensating cylinder that terminates in the discharge line 105. The discharge cylinders and the compensating cylinder are both driven with a hydraulic working cylinder, where the letters each refer to the unit consisting of discharge cylinders and drive cylinder. The end positions of the piston in the cylinders are signaled to the combinatorial circuit through impulses of sensors which are labeled with the letters a–f. These sensors control valves which are identified by arabic numerals. The control impulses of the sensors may be electric, hydraulic, mechanical or pneumatic.

The concrete flow control provided by the invention is accomplished with a swivel pipe 100 which on opposite sides of its entrance port contains one control disk 101 and 102 each and, therefore, is described as control valve (104). For the relay of motion serves a hydraulic drive which is generally marked with B. It is also controlled over a distribution valve that is shown at 3. A charge funnel contains on its side opposite to the openings of the discharge cylinders L and R a swivel bearing 103 for the control valve 104, as well as the non-turning connection of the pump side end of a concrete discharge line 105.

During the pumping, the combinatorial circuit accelerates the drive cylinder of the actually delivering discharge cylinder so that its discharge piston runs faster and thereby delivers more in this phase, which is proportionate to the measure of the concrete quantity removed by the compensating cylinder A from the charge funnel. This occurs through the feeding of additional hydraulic medium (oil). If the surface ratio of the compensating cylinder drive piston to the compensating cylinder delivery piston is the same as for the discharge cylinders, the hydraulic drive medium which the compensating cylinder drive piston displaces with its backside during the intake of the concrete from the discharge line through the exit cylinder discharge piston is sufficient.

The control valve 104 is switched over between the piston plays of the discharge cylinders R and L. In the form of execution according to FIG. 1, the switching occurs in two successive steps, of which the first holds the control valve fixed in a midposition between the openings of the two discharge cylinders. In this position, one of the gate valve disks 101 or 102 seals off the discharge cylinder opening of the discharge cylinder, which has been switched over from intake to delivery. This enables the piston of this discharge cylinder to compress the concrete that has previously been sucked in. At the end of this compression stroke, the combinatorial circuit initiates the second change-over step of the control valve 104 into the respective end position. Through this, the entrance port 106 of the control valve 104 is aligned with the opening of the delivering cylinder and the previously compressed concrete is pushed into the discharge line 105.

In a first form of execution of the invention, the middle change-over position of the control valve 104 is controlled by the distribution valve 7. In this, in the middle switch-over position, the control orifice for the return oil is closed off, whereby the control valve comes to a halt in the middle switch-over position. With a time interval, the valve 7 is switched further and reaches the other switch-over position. This frees a return flow control orifice at the end of the drive cylinder. With that, the switching of the control valves into the end position can take place.

Figure 5:
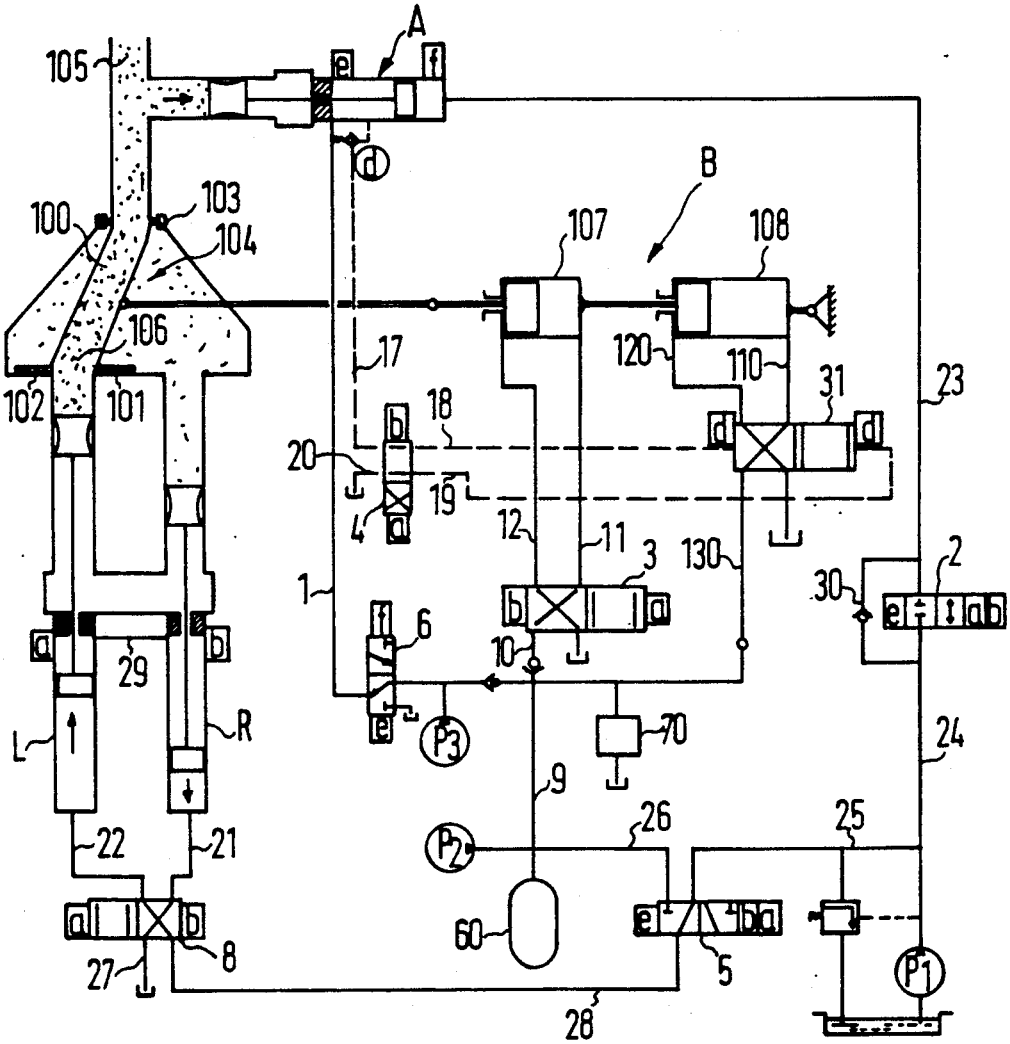
FIG. 5 an additional combinatorial circuit according to FIG. 1.

In a further form of execution of the invention, the middle change-over position of the control valve is determined by that for the drive of the control valves two drive cylinders switched in series are provided according to FIG. 5. With the operation of the first cylinder 107, the midposition is attained. At an interval of time, the operation of the second cylinder 108, through which the control valve 104 reaches its end position, takes place. In the course of this occurs the triggering of the first cylinder 107 by the valve 3, and that of the second cylinder 108, by the valve 31.

Figure 6:
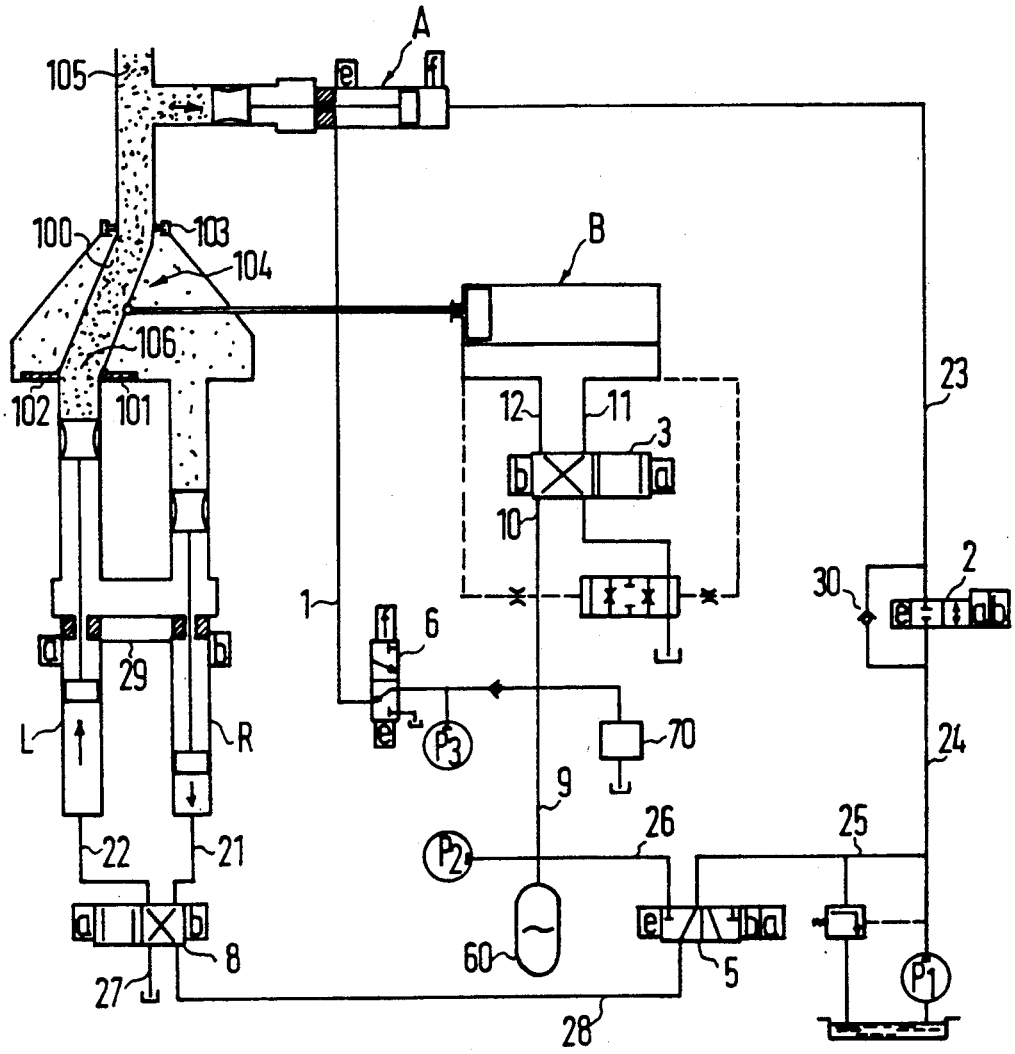
FIG. 6 an additional form of execution in the depiction according to FIG. 1 and 4.

With another preferred execution of the invention, the change-over of the control valves occurs parallel to the compression stroke, which results in a substantial reduction of the total time of interruption between the pumping strokes of the discharge cylinders according to equation (12) $t_A = t_{Sch} + t_K$ and therewith a reduction of the stroke volume of the compensating cylinder $V_A$ and of the factors $f_4$ and $f_5$ (ref. equations 14, 18, 20), and as result of that to a speed reduction of the piston of the pumping discharge cylinder. This possibility results from that at the beginning of the compression stroke no delivery of slurry into the discharge line occurs yet, because initially, due to the compensation for the Vacuum and air, pressure does not yet build up, and up to then, the control valve has reached its midposition quickly while subsequently, in the time span in which the compressing discharge piston compresses the slurry effectively, i.e. builds pressure, the control valve runs through its midposition range more or less strongly delayed until the compression is nearly completed, and thereafter the control valve passes through the Rest of its switch path again accelerated (FIG. 6).

For practical reasons of design, i.e. to keep the compensating cylinder as small as possible, but also for reasons of the adjustment of the control in the no-load position, it is useful to limit the compression stroke. The extent of the limitation ensues from the minimal volumetric efficiency factor $\eta_{vol}$ that corresponds to the general state of knowledge of the concrete flow property, i.e. the behavior of the concrete on suction. With $\eta_{vol} = 0.85$, the overwhelming range of all pumpable concretes and other slurries is covered.

Figure 3:
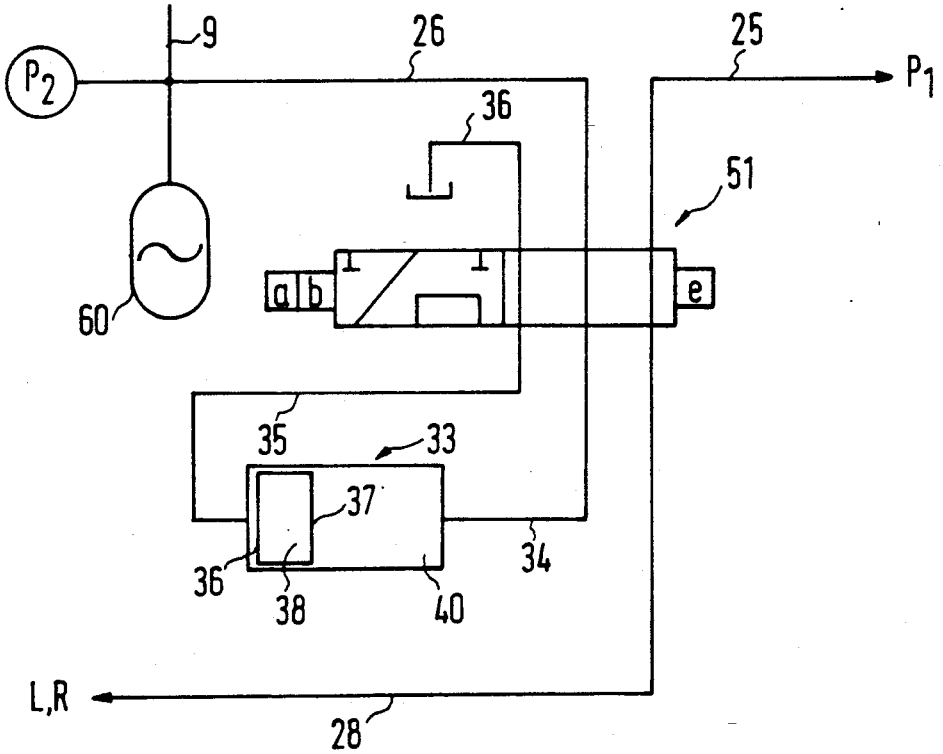
FIG. 3–4 further details of the combinatorial circuit.

According to the depiction of FIG. 3, the required limitation of the compression stroke occurs with a cylinder 33, in which a piston 38 is situated. The stroke volume 40 corresponds to the selected compression stroke limit. A valve 51 controls the cylinder in such a way, that in the phase of the compression stroke, the valve 51 is switched by one of the sensors a, b. Thereby compression fluid (oil) from a reservoir 60 loads the side 36 of the piston 38 through the line 35. The oil quantity displaced from the piston side 37 is through a line 34, 28 fed to the compressing discharge cylinder, until the piston 38 has reached its terminal position. The reversing of the Valve 51 through a sensor loads the reservoir side 37 of the piston 38. The oil displaced from the side 36 flows away to the Tank. This allows the return of the piston 38 to its starting position for the next compression.

Figure 4:
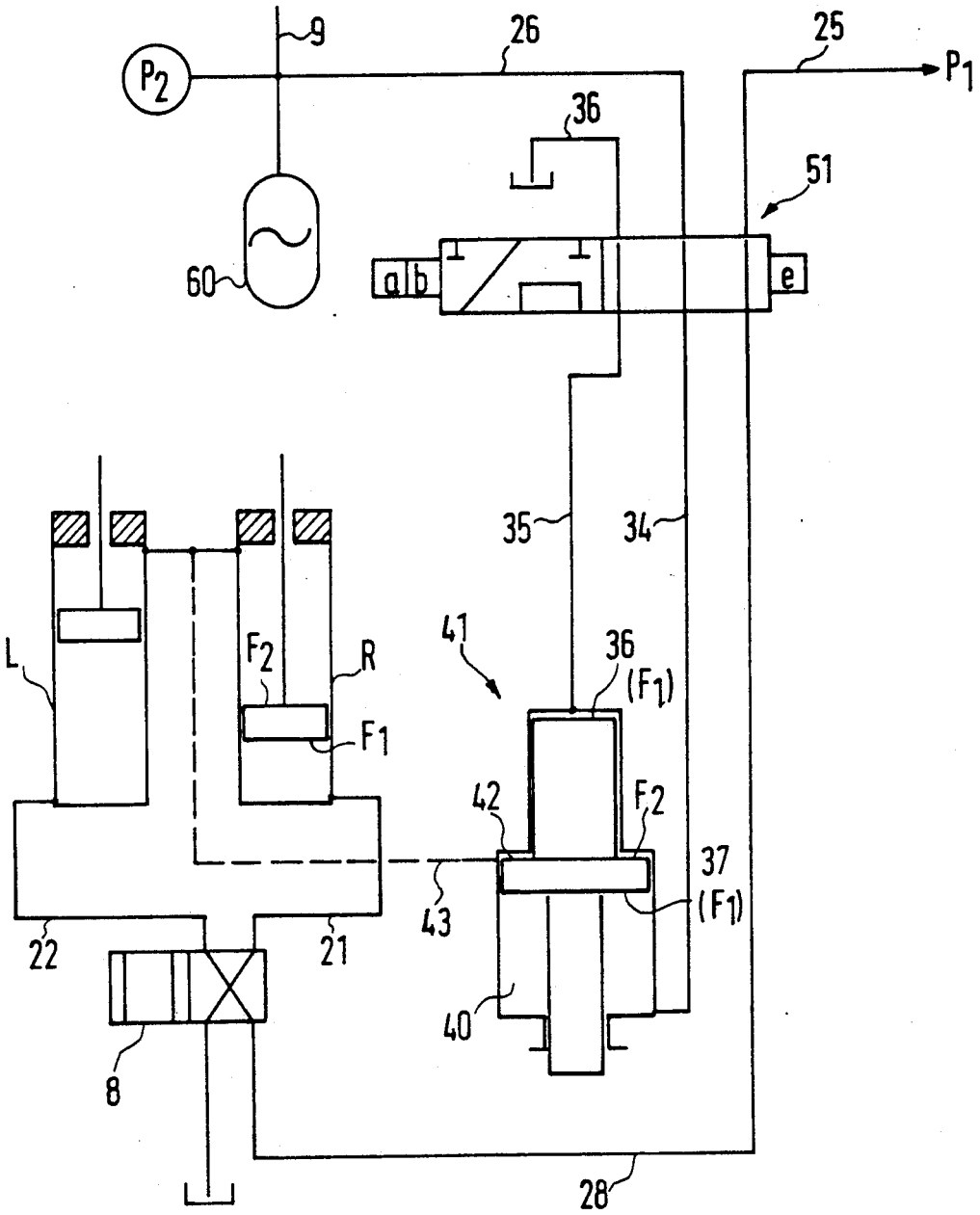

In the form of execution according to FIG. 4, there is provided that during the compression stroke of a discharge cylinder, the piston in the other discharge cylinder stands still, i.e. does not yet start its intake stroke. This compression stroke limitation is effected with a multiple chambered cylinder 41. It corresponds, in regard to the stroke limiting, in dimension, function and control to the cylinder 33 according to FIG. 3. However, it contains an additional chamber 42 that is dimensioned such that it accepts through the line 43 the hydraulic fluid displaced by the drive cylinder into the cross-over line during the compression stroke, and feeds it again into the bridge during the course of the following discharge stroke, and restores with that the synchronization of the run of the discharge cylinders.

A continuous concrete flow is achieved by that for the different cylinders L, R and A. Identical cylinder surface conditions/ratios as well as identical hydraulic quantities are available for the discharge stroke. The continuity of the pumping of concrete is assured by the hydraulic pump P1. Therefore, it is advantageous to provide for all other drives of the valves or the control valve, the intake stroke of the compensating cylinder A, etc., one or several separate other drive sources. This is accomplished by a second hydraulic circuit that is equipped with a reservoir 60, fed by a pump P2. It is provided with a safety and pressure turn-off valve 70.

For the intake stroke of the compensating cylinder is an auxiliary pump P3 provided, arranged such that in the phase, in which the compensating cylinder delivers the concrete, the pump P3 is not switched off, but the hydraulic medium supplied by it is through the line 9 additionally fed to the reservoir 60.

Instead of the auxiliary pump P3, a correspondingly enlarged pump P2 in connection with a larger reservoir, pertaining to the working volume, may be provided.

Furthermore, it is advisable to use all hydraulic changeover valves in the execution with shortest response time. In the hydraulic operation of the valve 2 through the sensor control point (e) by the pump medium P1, the reduction of the change-over time to a minimum is achieved through replacement of the valve 2 inclusive of the check valve 30 with the aid of a hydraulic pilot-controlled check valve.

Although the present invention has been described with reference to preferred embodiments, those skilled in the are will recognize that changes may be made in detail and form without departing from this spirit and scope of the invention.

What is claimed is:

1. A slurry pump for mixing concrete slurry, the slurry pump comprising:

a charge funnel;

a pair of discharge cylinders operable with the charge funnel so that slurry flows therebetween, each discharge cylinder having an opening through which the slurry flows and a drive for forcing the slurry though the opening;

a discharge line operable with the charge funnel so that slurry flows therebetween;

a control valve having an exit port connected with the discharge line and an entrance port that is alternatively positioned in front of the opening of each discharge cylinder;

a pair of gate valve disks, one on each side of the entrance port of the control valve, wherein the size of each gate valve disk conforms to a surface between the discharge cylinder openings such that in a change-over midpoint of the control valve the openings of the discharge cylinders are sealed off by the gate valve disks, and the entrance port in the control valve is sealed off on the surface between the discharge cylinders for the execution of a partial stroke of a discharge cylinder piston which compresses slurry in the discharge cylinder;

a compensation cylinder for preventing slurry interruptions during the change-over of the control valve; and a combinatorial circuit which controls the drive of each discharge cylinder and the slurry flow such that during a change-over of the control valve the compensation cylinder pushes slurry into the discharge line and such that during a subsequent discharge cycle of one of the discharge cylinders the compensation cylinder is filled with slurry, wherein the combinatorial circuit lets the drive of the discharge cylinder actually delivering slurry deliver faster in proportion to the amount of the slurry taken in by the compensation cylinder, and wherein the combinatorial circuit delays the change-over of the control valve such that one of the gate valve disks closes off the opening of the discharge cylinder associated with it.

2. Slurry pump with discharge cylinders, including a two-cylinder concrete pump with a slurry flow control between a charge funnel, the discharge cylinders and a discharge line, as well as a combinatorial circuit that controls the drives of the discharge cylinders and slurry flow, where the slurry flow passes through a control valve that with its exit port is always connected with the discharge line and is provided with at least one entrance port that alternatingly is positioned in front of the openings of the discharge cylinders, where a compensation cylinder during the change-over of the control valve prevents slurry interruptions, and the combinatorial circuit is designed such that the compensation cylinder during the change-over of the control valves pushes slurry into the discharge line and during the subsequent discharge cycle of one of discharge cylinders is filled with slurry, characterized by that the combinatorial circuit lets the drive of the actually delivering discharge cylinder deliver faster in proportion to the amount of the slurry taken in by the compensation cylinder, and delays the change-over of the control valve such that one of the gate valve disks belonging to each discharge cylinder on one side each of the entrance port of the control valve, the size of which conforms to a surface between the discharge cylinder openings such that in the changeover midpoint of the control valve the openings of the discharge cylinder are sealed off by the gate valve disks, and the entrance port in the control valve is sealed off on the surface between the discharge cylinders, and for the execution of a partial stroke of the discharge cylinder piston that comprises the drawn-in slurry, closes off the opening of the discharge cylinder belonging to it.

3. The slurry pump according to claim 1, wherein the compensation cylinder with its exit port is continuously connected with the discharge line and filled from it with slurry.

4. The slurry pump according to claim 1, wherein the combinatorial circuit has control elements in the form of position inquiry sensors and valves controlled by the position inquiry sensors, and wherein switch impulses are transmittable by electrical, hydraulic, mechanical or pneumatic means.

5. The slurry pump according to claim 1, wherein for the acceleration of the drives of the actually delivery discharge cylinders additionally hydraulic medium is supplied to the piston of a drive cylinder of the delivering discharge cylinder from the medium flowing back from a drive cylinder of the compensation cylinder.

6. The slurry pump according to claim 1, wherein the surface ratio of the compensation cylinder drive pistons to the compensation cylinder discharge piston is the same as for the discharge cylinders.

7. The slurry pump according to claim 1, wherein for the fixing of the midposition of the control valve a piston of the control valve drive seals off an assigned control orifice for return oil and brings the control valve to a half in the middle change-over position, where for a continuance of change-over of the valve into a further switch-over position, occurring at an interval of time, a return flow control orifice at the end of the drive cylinder opens up and initiates the switching of the control valve into the end position.

8. The slurry pump according to claim 1, wherein setting of the middle change-over position of the control valve in a control valve drive with two series-connected drive cylinders, which on operation of the first cylinder initiate the midposition, and at an interval of time occurring operation of the second cylinder do initiate the end position of the control valve, where for the control of the drive cylinder to each an individual change-over valve is assigned.

9. The slurry pump according to claim 1, wherein that the positions of the control valve for compressing and delivering are set such that at a high initial speed of the control valve, the control valve passes the midposition delayed and, toward the end of the control valve motion, the control valve is again accelerated to its initial speed, where the midposition delay occurs through insertion of flow control valves in the return of the control valve drive cylinders to execute the compression stroke.

10. The slurry pump according to claim 1 wherein the control valve drive is realized with differential, synchronized or plunger cylinders.

11. The slurry pump according to claim 1 wherein for the limiting of the compression strokes, a cylinder with a stroke volume tailored to the selected compression stroke limitation that is controlled by a valve in such a way that in the phase of compression a valve is switched through one of the sensors, and reservoir oil is loaded through the line on one side of a piston in the cylinder, where the displaced amount of hydraulic medium from the other piston side flows through lines to the compressing discharge cylinder until the piston has reached its terminal position, and that through reversing of the valve the reservoir loads the side of the piston and the hydraulic medium displaced from this side flows to the tank, and the piston returns to its starting position for the subsequent compression.

12. The slurry pump according to claim 1, wherein for the compression stroke limitation, the discharge piston is stopped in the adjacent discharge cylinder and the intake stroke is delayed with the aid of a multiple chambered cylinder, which contains an additional chamber that is dimensioned such that it accepts the hydraulic medium equivalent to the compression stroke, displaced by the drive cylinder of the compressing discharge cylinder into a cross-over line and, in the course of the subsequent discharge stroke feeds it again into the cross-over to restore the synchronization of the course of the discharge cylinder pistons.

13. The slurry pump according to claim 1 wherein for the execution of the discharge stroke of the discharge cylinder piston and of the discharge stroke of the compensation cylinder piston a hydraulic pump is provided.

14. The slurry pump according to claim 1 wherein for the drive of the control valve, for the execution of the compression stroke and for the switching of the valves a separate hydraulic circuit is provided, for which a pump and a reservoir fed by it, are provided with safety and pressure turn-off valve.

15. The slurry pump according to claim 1 wherein for the execution of the intake stroke of the compensation cylinder a further auxiliary pump is provided, arranged such that it feeds the hydraulic medium supplied by it during the discharge stroke of the compensation cylinder, through a line to the reservoir.

16. The slurry pump according to claim 1 wherein for the reduction of the change-over time of the compensation cylinders a hydraulically releasable check valve reduces the change-over time for the compensation cylinder drive to a minimum.

* * * * *

UNITED STATES PATENT AND TRADEMARK OFFICE

CERTIFICATE OF CORRECTION

PATENT NO. 5,316,453

DATED May 31, 1994

INVENTOR(S) FRIEDRICH SCHWING

It is certified that error appears in the above-indentified patent and that said Letters Patent is hereby corrected as shown below:

Col. 1, line 26, delete "simultaneous", insert --simultaneously--

Col. 1, line 28, delete "in", insert --is--

Col. 2, line 1, delete "that"

Col. 2, line 2, after "swivel", insert --pipe--

Col. 2, line 2, delete "pipe"

Col. 2, line 4, after "line", insert --and--

Col. 2, line 30, after "serves" insert --as--.

Col. 3, line 2, delete "precompression", insert --pre-compression--

Col. 3, line 18, delete "$^{v}$o", insert --$^{v}$o--

Col. 4, line 18, delete "f1", insert --$f$1--

Col. 4, line 20, delete "f1", insert --$f$1--

Col. 4, line 22, delete "f1", insert --$f$1--

Col. 4, line 53, delete "f2", insert --$f$2,--

Col. 4, line 65, delete "f2", insert --$f$2--

Col. 4, line 68, delete "f2", insert --$f$2--

Col. 5, line 1, delete 'f1 and f2", insert --$f$1 and $f$2--

Col. 5, line 5, delete "f3", insert --$f$3--

Col. 5, line 41, delete "changeover", insert --change-over--

UNITED STATES PATENT AND TRADEMARK OFFICE

CERTIFICATE OF CORRECTION

PATENT NO. : 5,316,453

DATED : May 31, 1994

INVENTOR(S) : Friedrich Schwing

It is certified that error appears in the above-indentified patent and that said Letters Patent is hereby corrected as shown below:

Col. 5, line 42, after "valves", insert a comma

Col. 5, line 42, after "valves", delete a comma

Col. 5, line 44, after "Accordingly", insert a comma

Col. 6, line 19, delete "($^{v}\rho$)", insert --($^{v}p$)--

Col. 6, line 50, delete "$^{t}$F1", insert --$^{t}f_1$--

Col. 6, line 55, delete "f4", insert --$f4$--

Col. 7, line 15, delete "$^{v}_{A}$32 25(dm$^3$)", insert --$^{v}A$ = 25 (dm$^3$)--

Col. 7, line 18, delete "f4", insert --$f4$--

Col. 7, line 20, delete "$f_4$=1.543.", insert --$f4$ = 1.543.--

Col. 7, line 22, delete "f5", insert --$f5$--

Col. 7, line 36, delete "$f_5$", insert --$f5$--

Col. 7, line 39, delete "$f_3$", insert --$f3$--

Col. 10, line 23, delete "changeover", insert --change-over--

UNITED STATES PATENT AND TRADEMARK OFFICE

CERTIFICATE OF CORRECTION

PATENT NO. : 5,316,453 Page 3 of 3

DATED : May 31, 1994

INVENTOR(S) : Friedrich Schwing

It is certified that error appears in the above-indentified patent and that said Letters Patent is hereby corrected as shown below:

Col. 10, line 32, delete "are", insert --art--
Col. 11, line 55, delete "delivery" insert --delivering--

Signed and Sealed this

Eighteenth Day of October, 1994

Bruce Lehman

*Attest:*

BRUCE LEHMAN

*Attesting Officer*

*Commissioner of Patents and Trademarks*